US010281945B2

(12) United States Patent
Hayashida et al.

(10) Patent No.: US 10,281,945 B2
(45) Date of Patent: May 7, 2019

(54) INFORMATION TERMINAL CONTROL METHOD AND INFORMATION SYSTEM

(71) Applicant: Panasonic Intellectual Property Management Co., Ltd., Osaka (JP)

(72) Inventors: Gaku Hayashida, Osaka (JP); Akio Nakano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 374 days.

(21) Appl. No.: 15/196,031

(22) Filed: Jun. 29, 2016

(65) Prior Publication Data

US 2017/0031377 A1 Feb. 2, 2017

(30) Foreign Application Priority Data

Jul. 30, 2015 (JP) ..... 2015-150634

(51) Int. Cl.
*G05F 1/66* (2006.01)

(52) U.S. Cl.
CPC ..... *G05F 1/66* (2013.01)

(58) Field of Classification Search
CPC ..... G05F 1/66
USPC ..... 702/182
See application file for complete search history.

(56) References Cited

U.S. PATENT DOCUMENTS

| | | | | |
|---|---|---|---|---|
| 9,244,444 | B2 * | 1/2016 | Carty | G05B 15/02 |
| 9,520,623 | B2 * | 12/2016 | Honma | H01M 10/44 |
| 9,685,822 | B2 * | 6/2017 | Nishiyama | H02J 13/0017 |
| 9,697,574 | B2 * | 7/2017 | Haga | H04Q 9/00 |
| 2010/0082174 | A1 * | 4/2010 | Weaver | H02J 3/14 700/295 |
| 2010/0324962 | A1 * | 12/2010 | Nesler | G01R 21/133 705/7.36 |
| 2015/0120075 | A1 * | 4/2015 | Le Roux | G01D 4/004 700/296 |

FOREIGN PATENT DOCUMENTS

JP 2015-087881 5/2015

* cited by examiner

*Primary Examiner* — Ricky Ngon
(74) *Attorney, Agent, or Firm* — Greenblum & Bernstein, P.L.C.

(57) ABSTRACT

An information terminal control method includes (a) accepting an instruction requesting for displaying of comparison between a power consumption of first electrical facilities provided in a first establishment and a power consumption of second electrical facilities provided in a second establishment, and (b) displaying, on a display, comparison data comparing between the power consumption of the first electrical facilities and the power consumption of the second electrical facilities, the comparison data being calculated with reduced influence of a difference between an environmental condition of the first electrical facilities that influences an efficiency of the first electrical facilities and an environmental condition of the second electrical facilities that influences an efficiency of the second electrical facilities.

8 Claims, 14 Drawing Sheets

INFORMATION TERMINAL CONTROL METHOD AND INFORMATION SYSTEM

BACKGROUND

1. Technical Field

The present disclosure relates to an information terminal control method and an information system that compares power consumption amounts for individual establishments and visualizes the results.

2. Description of the Related Art

Recently, the reduction of energy consumption in shops, or in other words energy conservation, is highly valued as a way to improve corporate image or improve profits. In particular, for corporations deploying multiple shop facilities, such as convenience stores and supermarkets, the cumulative effect of a slight energy conservation at each shop produces a large result, and energy conservation in each shop is being recommended.

For corporations deploying multiple shop facilities, there is demand to be able to manage energy conservation for the overall corporation by evaluating how much each shop is conserving energy. However, factors such as the types of facilities, number of stations, and facility operating conditions caused by the conditions of the shop's location (such as temperature, humidity, amount of sunshine, and amount of precipitation) are different for each shop, and thus simply comparing the total amount of power consumption by each shop is an insufficient way to evaluate energy conservation at each shop.

For example, Japanese Unexamined Patent Application Publication No. 2015-87881 discloses a technology that computes a normalized index value of the amount of power usage by facilities installed at multiple shops by using the hours of operation of each shop or the size of the shop layout, and compares the facilities of multiple shops based on the index value.

SUMMARY

The technology disclosed in Japanese Unexamined Patent Application Publication No. 2015-87881 makes an evaluation using an index that is normalized for the amount of power usage by facilities based on the hours of operation of the shop and the size of the shop layout. However, the amount of power consumption by facilities changes greatly depending on not only the conditions when the facilities are introduced, such as the facility operating times and size of the shop layout considered in Japanese Unexamined Patent Application Publication No. 2015-87881, but also how facilities are run after the facilities are introduced. In other words, with the technology disclosed in Japanese Unexamined Patent Application Publication No. 2015-87881, it is not possible to compare the amount of power consumption by each shop while also accounting for differences between methods of running facilities after the facilities are introduced.

In light of the above circumstances, the present disclosure provides a way to evaluate the amount of power consumption while also accounting for differences between methods of running facilities after the facilities are introduced.

One non-limiting and exemplary embodiment provides an information terminal control method and an information system enabling the evaluation of power consumption while also accounting for differences between methods of running facilities after the facilities are introduced.

In one general aspect, the techniques disclosed here feature an information terminal control method including (a) accepting an instruction requesting for displaying of comparison between a power consumption of first electrical facilities provided in a first establishment and a power consumption of second electrical facilities provided in a second establishment, and (b) displaying, on a display, comparison data comparing between the power consumption of the first electrical facilities and the power consumption of the second electrical facilities, the comparison data being calculated with reduced influence of a difference between an environmental condition of the first electrical facilities that influences an efficiency of the first electrical facilities and an environmental condition of the second electrical facilities that influences an efficiency of the second electrical facilities.

According to the present disclosure, it is possible to evaluate power consumption while also accounting for the method of running facilities after the facilities are introduced.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1A:
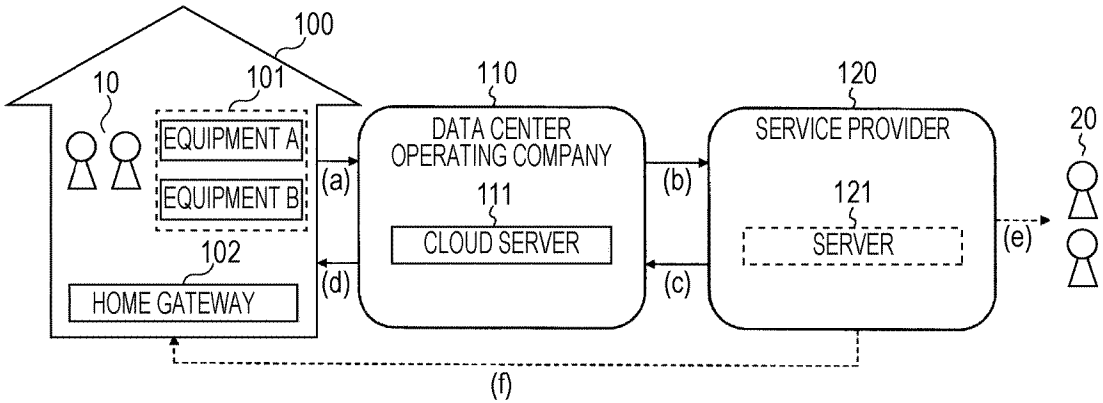
FIG. 1A is a diagram illustrating an example of an overall picture of an information providing system according to an embodiment of the present disclosure.

Hereinafter, an exemplary embodiment of the present disclosure will be described with reference to the drawings. FIG. 1A is a diagram illustrating an example of an overall picture of an information providing system according to an embodiment of the present disclosure. The group 100 is a group of any scale, such as a corporation, an organization, or a household, for example.

In the group 100, there exists a plurality of equipment 101 (equipment A, equipment B), and a home gateway 102. The plurality of equipment 101 may include both equipment that is able to connect to the Internet (information terminals such as a smartphone, PC, or TV, for example), as well as equipment that is unable to connect to the Internet by itself (electric appliances such as a range cooker, lighting, a washing machine, or a refrigerator, for example).

Equipment that is unable to connect to the Internet by itself may still be able to connect to the Internet via the home gateway 102. Also, the group 100 includes a user 10 who uses the plurality of equipment 101.

The data center operating company 110 includes a cloud server 111. The cloud server 111 is a virtualized server that interacts with various equipment via the Internet. The cloud server 111 mainly manages information such as big data that is difficult to handle using ordinary database management tools or the like.

The data center operating company 110 conducts activities such as managing data, managing the cloud server 111, and running a data center used to conduct such management. The role performed by the data center operating company 110 will be discussed later in detail.

Figure 1B:
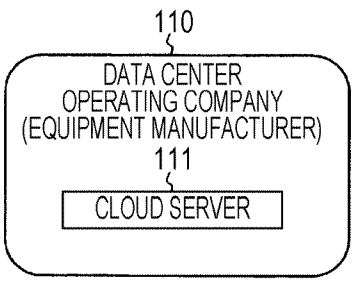
FIG. 1B is a diagram illustrating an example of a case in which a data center operating company is an equipment manufacturer.

Herein, the data center operating company 110 is not limited to being a company that only provides data management or runs the cloud server 111. FIG. 1B is a diagram illustrating an example of a case in which a data center operating company 110 is an equipment manufacturer.

For example, if an equipment manufacturer that develops or fabricates one of the pieces of equipment among the plurality of equipment 101 additionally provides data management or management of the cloud server 111, as illustrated in FIG. 1B, the equipment manufacturer corresponds to the data center operating company 110.

Figure 1C:
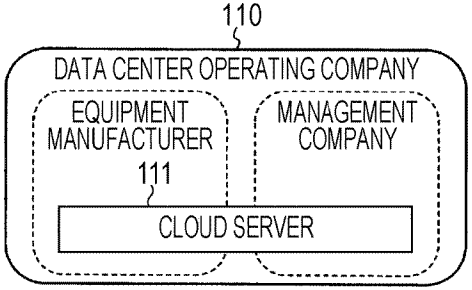
FIG. 1C is a diagram illustrating an example of a case in which a data center operating company is an equipment manufacturer and another management company.

Also, the data center operating company 110 is not limited to being a single company. FIG. 1C is a diagram illustrating an example of a case in which a data center operating company 110 is an equipment manufacturer and another management company. For example, if an equipment manufacturer and another management company jointly or separately provide data management or run the cloud server 111, as illustrated in FIG. 1C, either or both are taken to correspond to the data center operating company 110.

Returning to the description of FIG. 1A, the service provider 120 maintains a server 121. The server 121 referred to herein may be of any scale, including servers realized by memory and the like inside an individual user's PC, for example. Also, in some cases the service provider 120 does not maintain the server 121.

Note that in the above service, the home gateway 102 is not strictly required. For example, the home gateway 102 may be omitted in cases such as when the cloud server 111 manages all data. Also, in some cases, equipment unable to connect to the Internet by itself may not exist, such as in the case in which all equipment inside a home is connected to the Internet.

Next, a flow of information in the above service will be described. First, the equipment A and the equipment B of the group 100 transmit respective log information to the cloud server 111 of the data center operating company 110. The cloud server 111 collects the log information from the equipment A or the equipment B ((a) in FIG. 1A).

Herein, log information refers to information that indicates information such as running conditions or operating times for the plurality of equipment 101, for example. For example, the log information may include cooking information from a range cooker, viewing history from a television, recording schedule information from a recorder, running times and amounts of laundry from a washing machine, open/close times or an open/close count from a refrigerator. However, the log information is not limited to such information, and refers to all information acquirable from any kind of equipment.

In some cases, the log information may also be provided to the cloud server 111 directly from the plurality of equipment 101 itself via the Internet. Also, log information may be collected first in the home gateway 102 from the plurality of equipment 101, and provided from the home gateway 102 to the cloud server 111.

Next, the cloud server 111 of the data center operating company 110 provides the service provider 120 with the collected log information in fixed units. Herein, the units may be units into which the data center operating company is able to organize and provide collected information to the service provider 120, or units requested by the service provider 120. Also, although described as fixed units, the units may also not be fixed, and in some cases the amount of information to provide may vary depending on conditions.

The above log information is saved in the server 121 provided in the service provider 120 as appropriate ((b) in FIG. 1A). Subsequently, the service provider 120 organizes the log information into information adapted to a service to provide to a user, and provides the organized information to the user.

The user provided with the above information may be a user 10 who uses the plural equipment 101, or an external user 20. Additionally, the above information may also be provided directly from the service provider to users, for example ((e) and (f) in FIG. 1A). Also, the above information may be provided to users after traversing the cloud server 111 of the data center operating company 110 again, for example ((c) and (d) in FIG. 1A).

Furthermore, the cloud server 111 of the data center operating company 110 may also organize log information into information adapted to a service to provide to a user, and provide the organized information to the service provider 120.

Note that the user 10 and the user 20 may be the same person or different people.

Figure 2:
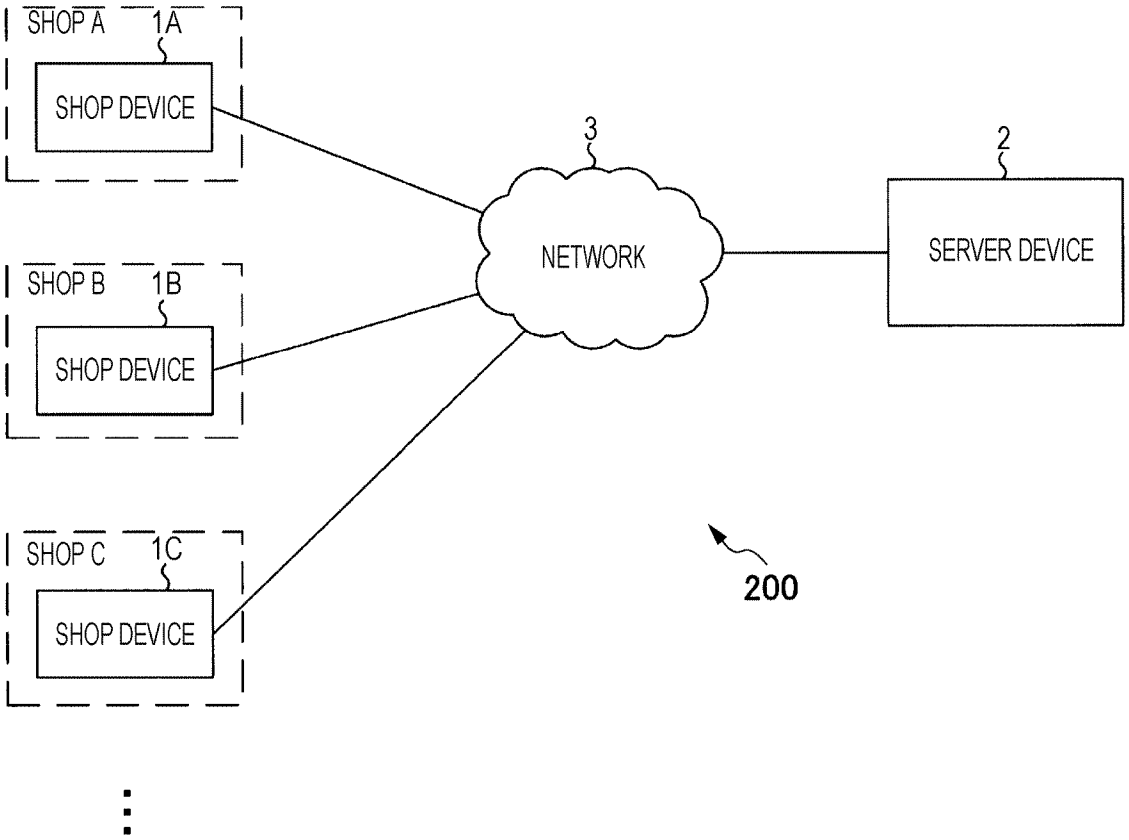
FIG. 2 is a diagram illustrating an example of a configuration of an information system according to an embodiment of the present disclosure.

Next, an example of an information system according to an embodiment of the present disclosure will be described. FIG. 2 is a diagram illustrating an example of a configuration of an information system according to an embodiment of the present disclosure. As illustrated in FIG. 2, the information system 200 is equipped with shop devices 1A, 1B, 1C, and so on provided in each of multiple shops A, B, C, and so on, as well as a server device 2 and a network 3. Each of the shop devices 1A, 1B, 1C, and so on is connected to the server device 2 over the network 3. The network 3 may be a wired network, a wireless network, or a combination of the two.

Note that a shop herein refers to one shop of a corporation possessing multiple shops, such as a convenience store or a supermarket, for example. Note that in FIG. 2, although the number of shops is the three shops from A to C, the present disclosure is not limited thereto, and it is sufficient to have at least two shops in the present disclosure. Also, in FIG. 2, only one server device 2 is illustrated, but the number of server devices 2 may also be two or more.

Figure 3:
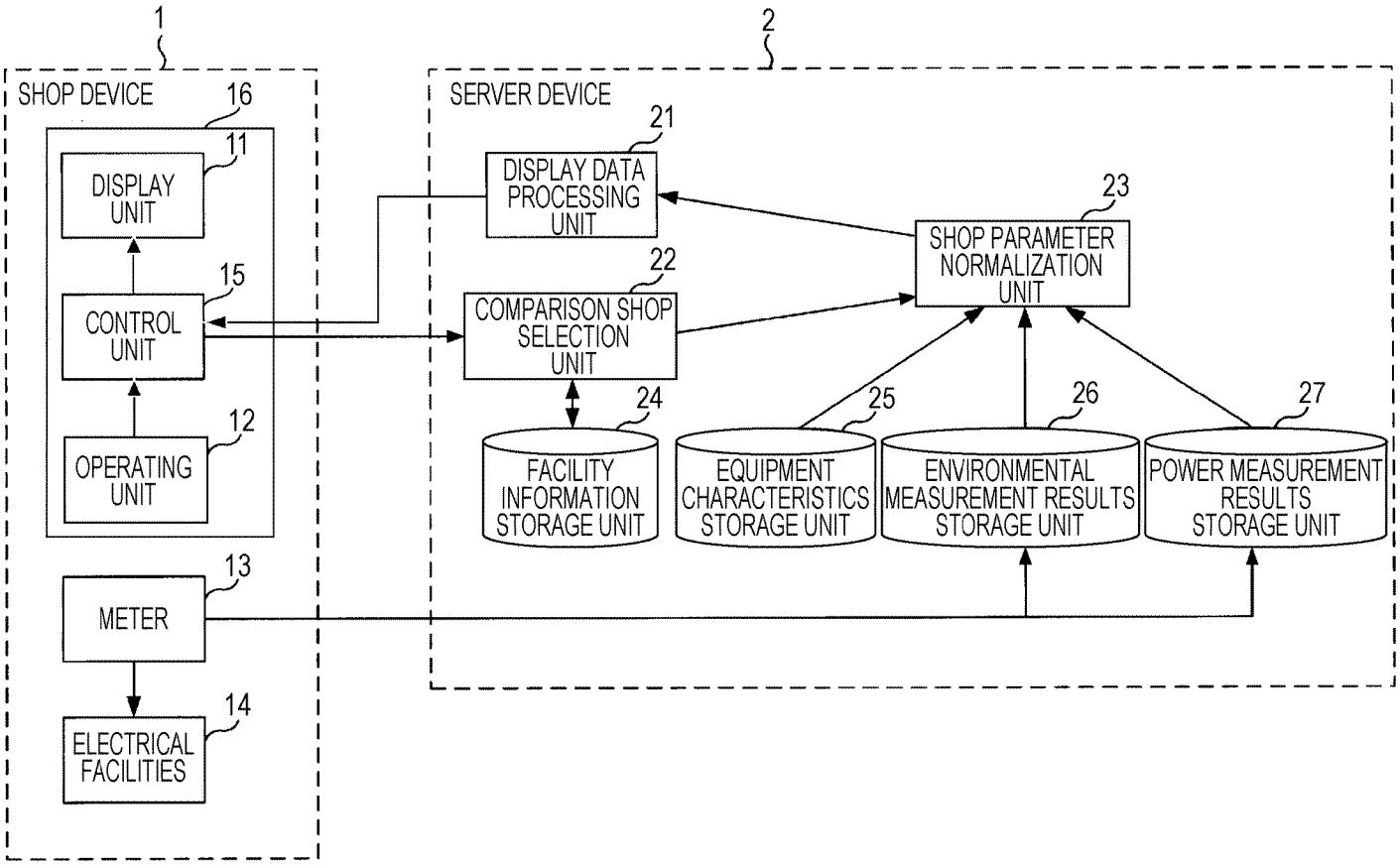
FIG. 3 is a diagram illustrating an example of a configuration of a shop device and a server device.

FIG. 3 is a diagram illustrating an example of a configuration of a shop device 1 and a server device 2. The configuration of the shop devices 1A, 1B, and 1C installed in each of the shops A, B, C, and so on is mostly similar. In the following description, the shop devices 1A, 1B, 1C, and so on, or any one such shop device, will be collectively designated the shop device 1.

The shop device 1 will now be described. As illustrated in FIG. 3, the shop device 1 is equipped with a meter 13, electrical facilities 14, and an information terminal 16. The information terminal 16 is equipped with a display unit 11, an operating unit 12, and a control unit 15. The display unit 11 is a display device such as a liquid crystal display, an organic EL (OLED) display, or a CRT monitor, for example, and displays certain screens. The operating unit 12 is a device such as a keyboard, a mouse, or a touch panel that accepts instructions from an operator via operations performed by the operator. The control unit 15 controls the display unit 11. The control unit 15 transmits instructions from the operator accepted by the operating unit 12 to the server device 2 via a communication device (not illustrated) for wired communication or wireless communication. The control unit 15 may be any device having control functions, and is equipped with a computational processor (not illustrated) and storage (not illustrated) that stores a control program. Examples of a computational processor include an MPU or a CPU. An example of storage is memory. Note that the control unit may also be configured as a single control unit that performs centralized control, or be configured as multiple control units that cooperate with each other to perform decentralized control. The display unit 11 is an example of a display according to the present disclosure, while the operating unit 12 is an example of an accepter according to the present disclosure. The control unit 15 is included in a controller according to the present disclosure.

Note that although the display unit 11 and the operating unit 12 are illustrated separately in FIG. 3, the display unit and the operating unit may also be configured integrally, like in a device such as a tablet equipped with a touch panel display, for example.

The meter 13 is a power sensor that measures the power consumption of the electrical facilities 14. Additionally, the meter 13 may also include sensors other than the power sensor, including sensors that measure parameters related to the outside environment where the shop is located, such as a temperature and humidity sensor that measures the outside temperature and humidity near the shop, and a sunlight sensor that measures the amount of sunshine incident on the shop, for example.

The electrical facilities 14 includes equipment such as refrigeration facilities and freezer facilities, such as refrigerated and frozen showcases and a walk-in refrigerator, and air conditioning facilities, such as an air conditioner and a cooler, for example. Note that the electrical facilities according to the present disclosure may also include other types of facilities, including lighting facilities such as fluorescent lights, electric heating facilities such as a hot drink server and an Oden pot, for example, but in the present embodiment, for the sake of simplicity, refrigeration facilities, freezer facilities, and air conditioning facilities are described as the electrical facilities 14.

Next, the server device 2 will be described. The server device 2 is equipped with a display data processing unit 21, a comparison shop selection unit 22, a shop parameter normalization unit 23, a facility information storage unit 24, an equipment characteristics storage unit 25, an environmental measurement results storage unit 26, and a power measurement results storage unit 27.

The display data processing unit 21 generates display data to be displayed by the display unit 11 of the shop device 1. The comparison shop selection unit 22, in response to a shop employee instruction given by a certain operation performed on the operating unit 12 of the shop device 1 by a shop employee of a shop, selects a shop to compare the current shop against from among multiple shops. The shop parameter normalization unit 23 computes a normalized power amount by normalizing the total power consumption of the shop selected by the comparison shop selection unit 22 according to factors such as the environmental conditions of the shop and the characteristics of the electrical facilities 14. The facility information storage unit 24 stores information related to the facilities in each shop. The equipment characteristics storage unit 25, the environmental measurement results storage unit 26, and the power measurement results storage unit 27 store various information used in the normalization by the shop parameter normalization unit 23. The display data processing unit 21 is included in a controller according to the present disclosure. In other words, the display data processing unit 21 and the control unit 15 are an example of a controller according to the present disclosure, and both cooperate with each other to realize the functions of a controller according to the present disclosure. The shop parameter normalization unit 23 is an example of a calculator according to the present disclosure.

Figure 4:
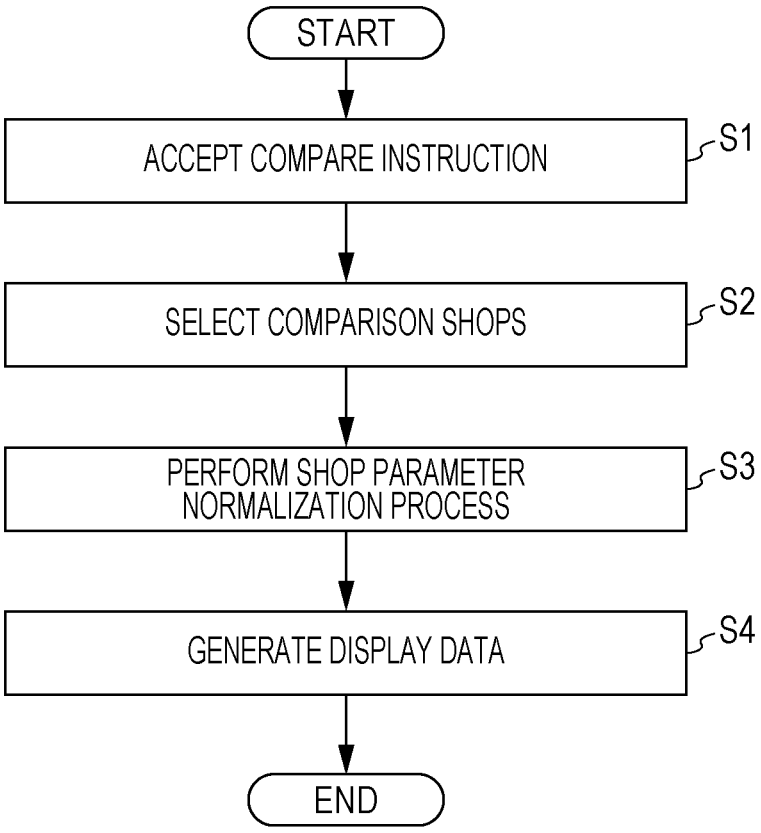
FIG. 4 is a flowchart illustrating an example of the operation of a server device.

Hereinafter, the operation of each component of the server device 2 will be described. FIG. 4 is a flowchart illustrating an example of operations of the server device 2. First, in step S1, the comparison shop selection unit 22 receives, from the operating unit 12 of a shop, a request signal indicating that an instruction requesting a display related to the evaluation of power consumption at the shop has been performed, and accepts the instruction. In other words, when the above request instruction is performed via the operating unit 12 by someone such as a shop employee of the shop, the control unit 15 transmits the above request signal to the comparison shop selection unit 22 via the communication device of the information terminal 16. Note that an evaluation of power consumption at a shop means comparison data comparing the power consumption over a certain period, such as one month, for example, with multiple other shops. Herein, comparison data comparing a shop to multiple other shops may mean the results of comparing the shop in question to one or more other specific shops, or may also include displaying the power consumption of the shop in question and the power consumption of one or more other shops. In cases in which the comparison data means displaying the power consumption of the shop in question and the power consumption of one or more other shops, the comparison between the shop in question and another shop may be performed by someone such as a shop employee referring to the display. In the following description, the shop at which an operation requesting a display related to the evaluation of power consumption at the shop is performed on the operating unit 12 will be designated the base shop (that is, the shop that serves as the base of reference).

The comparison shop selection unit 22 receiving the request for a display related to the evaluation of power consumption from the operating unit 12 of the base shop selects one or more shops to be compared to the base shop (step S2). The shops that may be selected are the multiple shops deployed by the corporation to which the base shop belongs, for example. The method of selection by the comparison shop selection unit 22 is not particularly limited in the present disclosure. In other words, depending on the selection criteria of the selection method implemented by the comparison shop selection unit 22, the one or more selected shops may be a subset of the shops which may be selected, or all of the shops.

One example of the selection method of the comparison shop selection unit 22 is a method of extracting a shop equipped with facilities similar to those of the base shop, based on information related to the facilities of the other shops stored in the facility information storage unit 24, for example. Note that facilities similar to those of the base shop means that the total value of the rated power of the electrical facilities 14 provided in each shop and the hours of operation of the shops are nearly the same, for example. In the following description, a shop selected by the comparison shop selection unit 22 will be designated a comparison shop.

The shop parameter normalization unit 23 normalizes one month of power consumption at each comparison shop selected in step S2, based on various information read out from the equipment characteristics storage unit 25, the environmental measurement results storage unit 26, and the power measurement results storage unit 27 (step S3). The normalization process performed by the shop parameter normalization unit 23 will be discussed later in detail.

Figure 5:
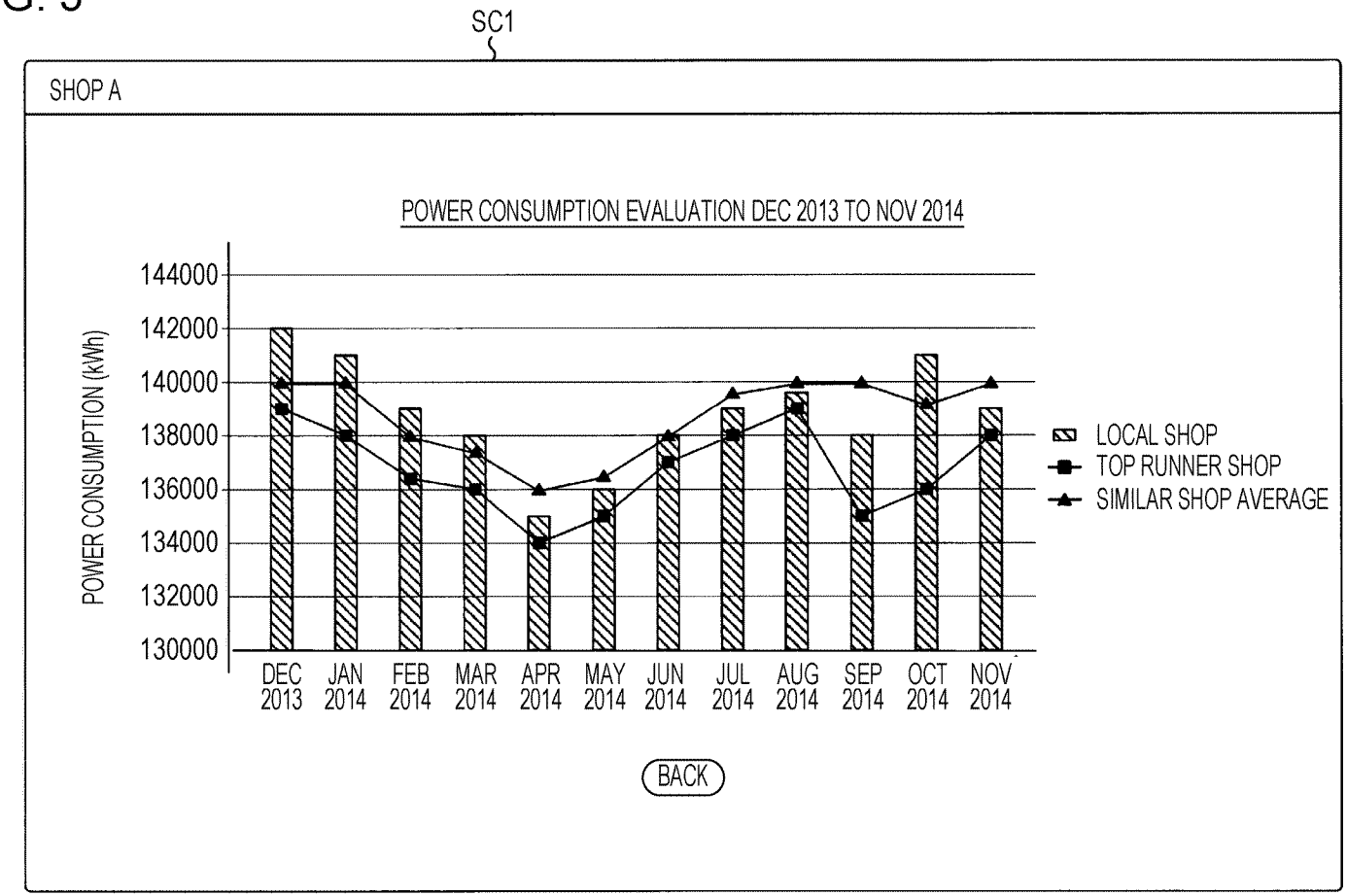
FIG. 5 is a diagram illustrating an example of an evaluation display screen.

The display data processing unit 21 generates an evaluation display screen for displaying the evaluation results of the power consumption of the base shop generated by the shop parameter normalization unit 23, and transmits the generated evaluation display screen to the display unit 11 of the base shop (step S4). FIG. 5 is a diagram illustrating an example of an evaluation display screen.

As an example, the evaluation display screen SC1 illustrated in FIG. 5 is a screen displaying power consumption for the previous year as of December 2014. The power consumption of the base shop (local shop) is illustrated by a bar graph for each month, while the power consumption of the top runner shop and a similar shop average are respectively displayed as line charts. Herein, the top runner shop refers to the shop with the lowest power consumption each month from among the multiple shops referenced in the comparison. The similar shop average refers to the average monthly power consumption of all shops referenced in the comparison.

The evaluation display screen SC1 illustrated in FIG. 5 is displayed on the display unit 11, and a shop employee referring to the evaluation display screen SC1 becomes able to compare the amount of power consumption at the local shop, and make a suitable evaluation regarding energy conservation at the local shop.

Figure 6:
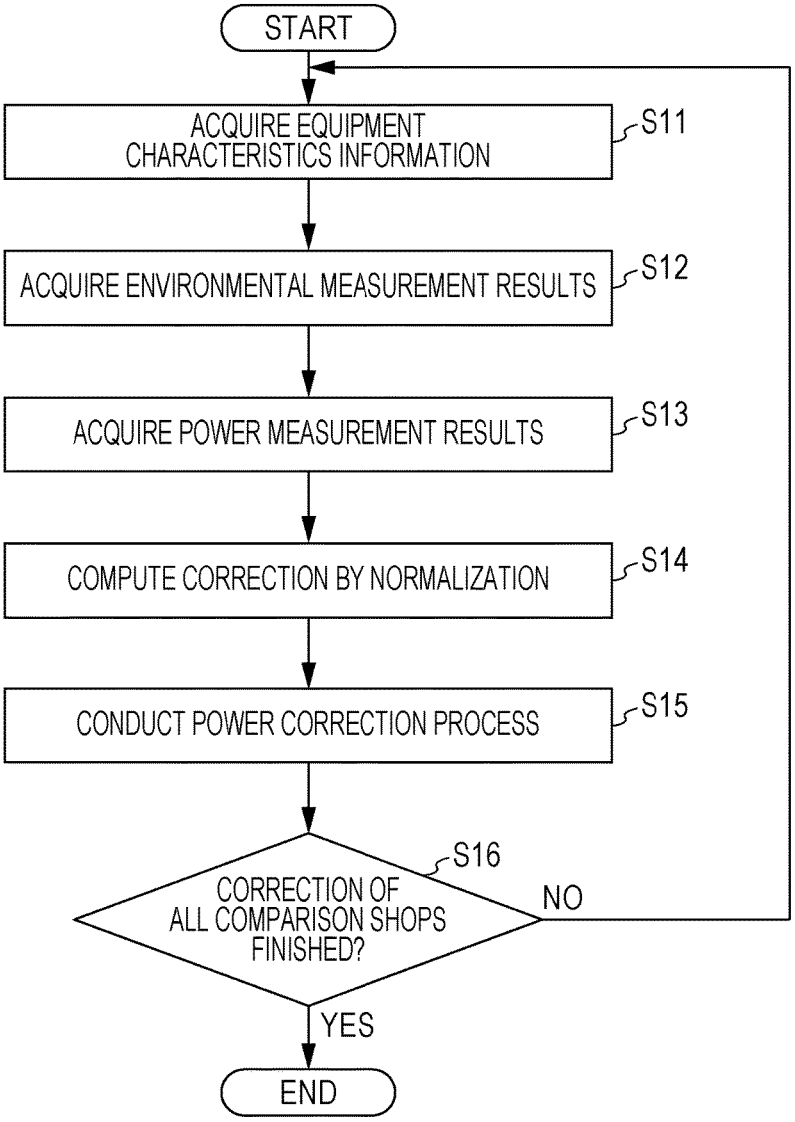
FIG. 6 is a flowchart for explaining a normalization process by a shop parameter normalization unit.

Next, the normalization process performed by the shop parameter normalization unit 23 will be described in detail. FIG. 6 is a flowchart for explaining the normalization process performed by the shop parameter normalization unit 23. In FIG. 6, for the sake of simplicity, a case is supposed in which identical models and identical numbers of electrical facilities 14 are installed in the base shop and the one or more comparison shops.

The shop parameter normalization unit 23 acquires information related to the equipment characteristics of each comparison shop from the equipment characteristics storage unit 25 (step S11). The equipment characteristics storage unit 25 stores information related to the equipment characteristics of the electrical facilities 14 in each shop. The information related to the equipment characteristics means information related to the relationship between changes in environmental conditions and changes in the power consumption of facilities in the case of using the electrical facilities 14 according to standard parameters.

Figure 7A:
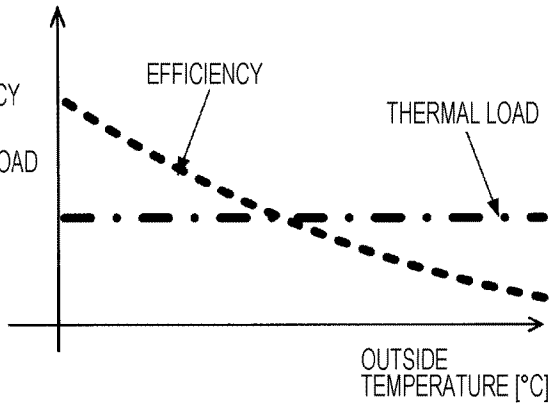
FIG. 7A is a diagram illustrating a relationship between the efficiency and thermal load in electrical facilities, the outside temperature as an example of an environmental condition, and equipment characteristics.
Figure 7B:
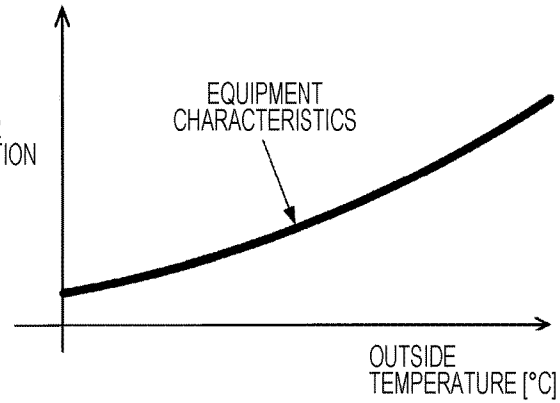
FIG. 7B is a diagram illustrating equipment characteristics of the refrigeration facilities and freezer facilities illustrated in FIG. 7A.

FIGS. 7A and 7B are diagrams for explaining the equipment characteristics of refrigeration facilities and freezer facilities as an example of the electrical facilities 14. FIGS. 7A and 7B suppose a case in which, as the standard usage mode of the refrigeration facilities and the freezer facilities, the indoor temperature is 20° C., the set temperature of the refrigeration facilities is 5° C., and the set temperature of freezer facilities is −10° C.

FIG. 7A is a diagram illustrating the relationship between the efficiency and thermal load in the refrigeration facilities and the freezer facilities, and the outside temperature as an example of an environmental condition. As illustrated in FIG. 7A, if it is supposed that the indoor temperature inside the shop does not change greatly throughout the year, the thermal load (indicated by the chain line) becomes nearly constant, irrespective of changes in the outside temperature. However, the environmental conditions of the shop where the refrigeration facilities and the freezer facilities are installed, or in other words the outside temperature, exerts a great influence on the efficiency (indicated by the dashed line) of the facilities. An environmental condition refers to the outside temperature outside the shop, for example. As illustrated in FIG. 7A, the efficiency of the refrigeration facilities and the freezer facilities rises as the outside temperature falls, due to the typical properties of a heat pump.

Note that in the example illustrated in FIG. 7A and FIG. 7C discussed later, the outside temperature is given as an example of an environmental condition of the shop, but the present disclosure is not limited thereto. For example, the outside humidity or the amount of sunshine may also be adopted as environmental conditions.

FIG. 7B is a diagram illustrating equipment characteristics of refrigeration facilities and freezer facilities illustrated in FIG. 7A. Generally, since (power consumption of electrical facilities)=(thermal load)/(efficiency), from the thermal load and the efficiency illustrated in FIG. 7A, the curve indicating the power consumption versus the outside temperature for the refrigeration facilities and the freezer facilities becomes like the one illustrated in FIG. 7B.

Figure 7C:
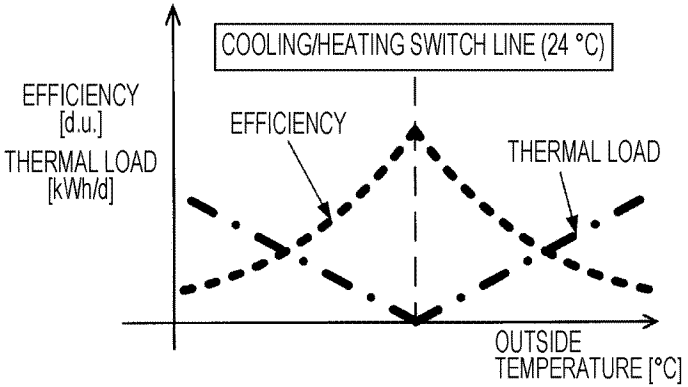
FIG. 7C is a diagram illustrating a relationship between the efficiency and thermal load in air conditioning facilities, and the outside temperature.
Figure 7D:
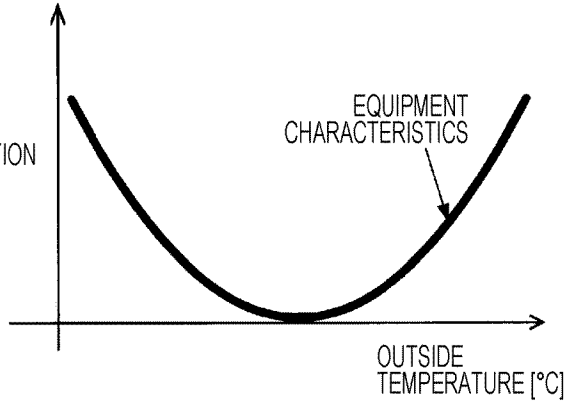
FIG. 7D is a diagram illustrating equipment characteristics of the air conditioning facilities illustrated in FIG. 7C.

As another example, FIGS. 7C and 7D are diagrams for explaining the equipment characteristics of air conditioning facilities as another example of the electrical facilities 14. FIGS. 7C and 7D suppose a standard usage mode of the air conditioning facilities in which the set temperature is locked to 24° C., and cooling or heating switches automatically at a threshold of 24° C.

FIG. 7C is a diagram illustrating a relationship between the efficiency and thermal load in air conditioning facilities, and the outside temperature. As illustrated in FIG. 7C, the thermal load (indicated by the chain line) is proportional to the difference between the indoor temperature and the outside temperature. Meanwhile, similarly to the refrigeration facilities and the freezer facilities, the air conditioning facilities are also greatly influenced by the environmental conditions of the shop where the air conditioning facilities are installed, or in other words the outside temperature. Specifically, the efficiency of a refrigerated showcase (indicated by the dashed line) rises as the outside temperature falls, and falls as the outside temperature rises, due to the typical properties of a heat pump.

FIG. 7D is a diagram illustrating equipment characteristics of the air conditioning facilities illustrated in FIG. 7C. From the thermal load and the efficiency illustrated in FIG. 7C, the curve indicating the power consumption versus the outside temperature for the refrigerated showcase becomes like the one illustrated in FIG. 7D.

The equipment characteristics illustrated in FIGS. 7B and 7D are unique for each model of the electrical facilities 14, and identical models of equipment exhibit nearly the same characteristics. In the flowchart illustrated in FIG. 6, it is supposed that identical models and identical numbers of the electrical facilities 14 are installed in the base shop and the one or more comparison shops, and thus the equipment characteristics storage unit 25 stores information related to the equipment characteristics of the refrigeration facilities, the freezer facilities, and the air conditioning facilities installed in the base shop. In addition, in step S11 illustrated in FIG. 6, the shop parameter normalization unit 23 acquires information related to the equipment characteristics of the refrigeration facilities, the freezer facilities, and the air conditioning facilities installed in the base shop from the equipment characteristics storage unit 25.

Note that the information related to the equipment characteristics corresponding to the model of the electrical facilities 14 may be computed in advance based on actual running conditions by operating the facilities at various outside temperatures and measuring the power consumption, or be computed theoretically based on factors such as the thermal load and the efficiency of the electrical facilities 14 as described above.

The description will now return to the flowchart illustrated in FIG. 6. Next, the shop parameter normalization unit 23 acquires the environmental conditions of the base shop and each comparison shop from the environmental measurement results storage unit 26, specifically information related to the average outside temperature for a certain period (step S12). The information related to the average outside temperature for a certain period herein refers to information related to the outside temperature for a period determined by an operation performed on the operating unit 12 of the base shop, for example, and is information related to the outside temperature over one month or one year, for example. Note that the environmental measurement results storage unit 26 may also store information other than information related to the outside temperature as the environmental conditions of each shop, such as information related to the outside humidity, the amount of sunshine, and the size of the shop layout.

Subsequently, the shop parameter normalization unit 23 acquires information to the past power consumption of the base shop and each comparison shop from the power measurement results storage unit 27 (step S13). Information related to the monthly power consumption of each shop is stored in advance in the power measurement results storage unit 27, for example, and the shop parameter normalization unit 23 acquires information related to the power consumption over a certain period, such as a year, for example, from the power measurement results storage unit 27.

Figure 8A:
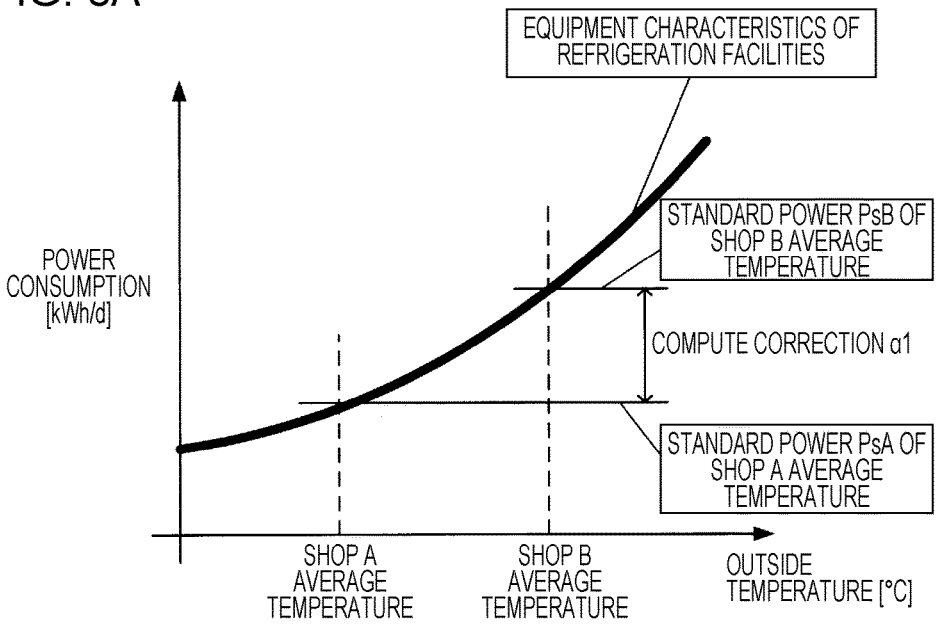
FIG. 8A is a diagram illustrating an example of normalizing the power consumption of a shop B acting as a comparison shop by the environmental conditions of a shop A acting as a base shop, based on the equipment characteristics of electrical facilities, and computing a correction.
Figure 8B:
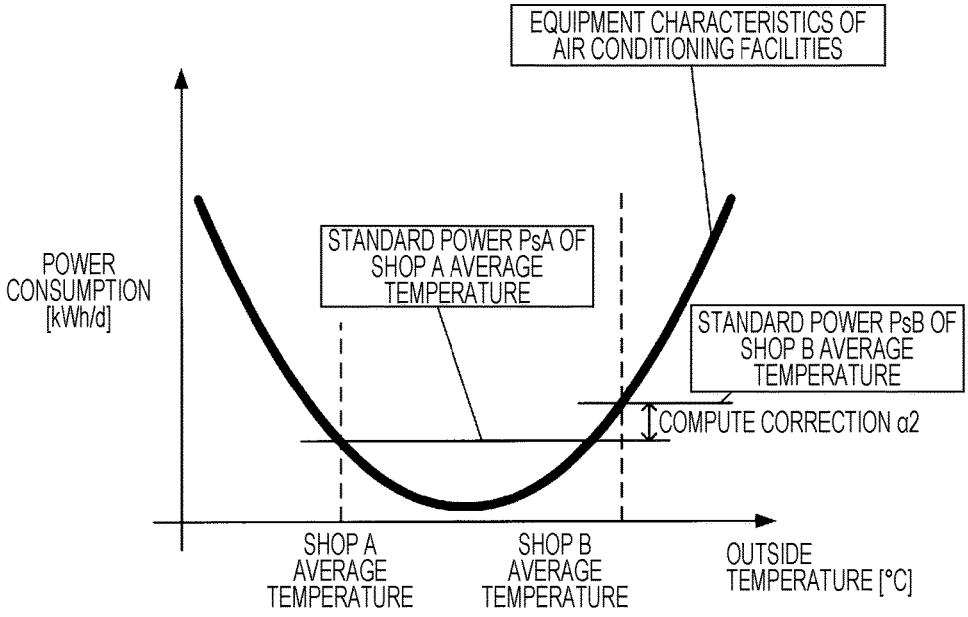
FIG. 8B is a diagram illustrating an example of normalizing the power consumption of a shop B acting as a comparison shop by the environmental conditions of a shop A acting as a base shop, based on the equipment characteristics of electrical facilities, and computing a correction.

Based on the information acquired from steps S11 to S13, the shop parameter normalization unit 23 normalizes the power consumption of the one or more comparison shops by the environmental conditions of the base shops, and computes a correction. FIGS. 8A and 8B are diagrams illustrating an example of correction computation by the shop parameter normalization unit 23.

FIG. 8A illustrates an example of normalizing the power consumption of a shop B acting as a comparison shop by the environmental conditions of a shop A acting as the base shop, based on the equipment characteristics of the refrigeration facilities and the freezer facilities, and computing a correction. As a presupposition, it is supposed that identical models and identical numbers of refrigeration facilities and freezer facilities are installed in shop A and shop B. Also, in the diagram illustrated in FIG. 8A, similarly to FIGS. 7A and 7B, it is supposed that the refrigeration facilities and the freezer facilities are used in a standard usage mode. FIG. 8B is also similar. For this reason, the difference in the running states of the refrigeration facilities and the freezer facilities depending on the environmental conditions, namely the outside temperature, is expressed as a difference in power consumption in the refrigeration facilities and the freezer facilities between shop A and shop B. In the shop parameter normalization unit 23 according to the present embodiment, normalization means correcting this difference in power consumption caused by a difference in outside temperature.

A specific method of correction computation by normalization is as follows. First, as illustrated in FIG. 8A, the shop parameter normalization unit 23 computes a standard power consumption PsB for the average temperature of the shop B from the equipment characteristics of the refrigeration facilities and the freezer facilities. Similarly, the shop parameter normalization unit 23 computes a standard power consumption PsA for the average temperature of shop A. Subsequently, the shop parameter normalization unit 23 computes the difference between PsA and PsB (the value obtained by subtracting PsA from PsB), and treats this difference as a correction $\alpha 1$. Similarly, as illustrated in FIG. 8B, the shop parameter normalization unit 23 computes a correction $\alpha 2$ for the air conditioning facilities.

Herein, the standard power consumption means the power consumption of a shop when, for a certain outside temperature, the electrical facilities installed in the shop are operated according to a standard operating method. Consequently, the standard power consumption PsA corresponds to the power consumption of shop A when, at the average temperature of shop A, the electrical facilities of shop A are operated according to a standard operating method. Likewise, the standard power consumption PsB corresponds to the power consumption of shop B when, at the average temperature of shop B, the electrical facilities of shop B are operated according to a standard operating method. The standard operating method is set appropriately as the operating method of shop facilities. For example, the standard operating method may be an average operating method for the electrical facilities in the base shop (in this example, shop A), or an average operating method for the electrical facilities in a standard shop. The standard shop may be a real shop or a virtual shop.

The description will now return to the flowchart illustrated in FIG. 6. Next, the shop parameter normalization unit 23 uses the correction computed in step S14 to compute the power consumption of the comparison shop normalized by using the base shop as a base of reference (hereinafter designated the normalized value) (step S15). In the case of shop B given as an example in FIGS. 8A and 8B, the normalized value PnB is the value obtained by adding the correction $\alpha$1 of the refrigeration facilities and the freezer facilities and the correction $\alpha$2 of the air conditioning facilities to a measured value PB. The measured value PB is a value computed from the past power consumption of shop B acquired in step S13, and may be an average of past power consumption of shop B, for example.

Subsequently, the shop parameter normalization unit 23 determines whether or not a normalized value has been computed for all comparison shops (step S16). If the computation of a normalized value is complete for all comparison shops, the process ends. Otherwise, the flow returns to step S11.

Figure 9:
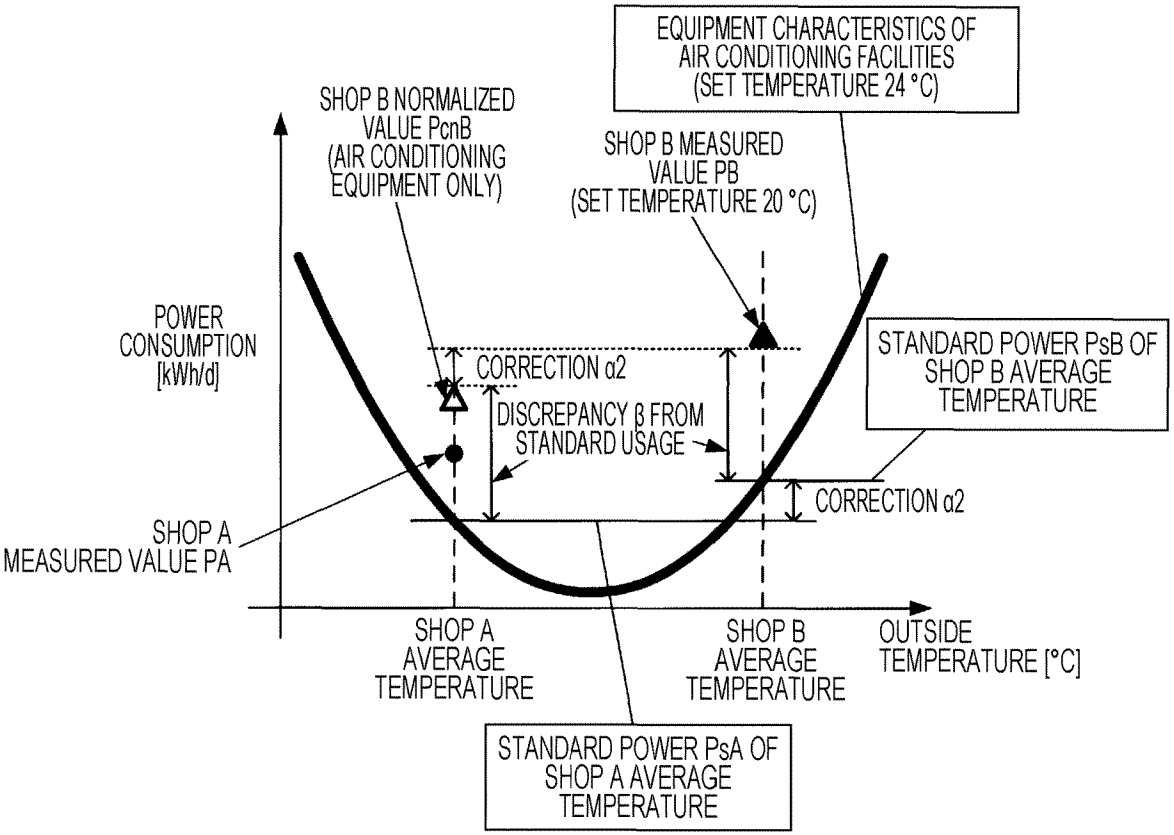
FIG. 9 is a diagram for explaining a case in which a non-standard usage mode is carried out at a shop B.

Note that in the process of correction computation by normalization in step S14 of FIG. 6, the equipment characteristics are supposed for a case of using each of the facilities according to a standard usage mode as discussed above. Specifically, in the normalization of the air conditioning facilities illustrated in FIG. 8B, for example, equipment characteristics in which the set temperature of the air conditioning facilities is locked to 24° C. and cooling or heating switches automatically at a threshold of 24° C. are used. However, a correction may also be computed according to the above method, even in cases in which the usage mode of the electrical facilities 14 in a comparison shop is not the standard usage mode, for example. FIG. 9 is a diagram for explaining a case in which a non-standard usage mode is used at shop B.

The curve indicating the equipment characteristics of the air conditioning facilities illustrated in FIG. 9 presupposes a set temperature of 24° C. as the standard usage mode. If the usage mode of the air conditioning facilities in shop B is non-standard, such as if the set temperature is 20° C., for example, the air conditioning facilities conduct cooling operation with greater output than in the standard usage mode, and thus the measured value PB of power consumption in shop B becomes greater than the amount consumed in the standard usage mode. In FIG. 9, this discrepancy is indicated as the discrepancy $\beta$ from the standard usage mode.

On the other hand, a normalized value PcnB of shop B related to the air conditioning facilities is computed by subtracting the correction $\alpha$2 computed by a method similar to FIG. 8B from the measured value PB of the power consumption, and this normalized value PcnB of shop B becomes the value obtained by adding the discrepancy $\beta$ from the standard usage mode to the standard power consumption PsA at the average temperature of shop A. Although only information regarding the air conditioning facilities is illustrated in FIG. 9, the refrigeration facilities and the freezer facilities are similar.

Note that in the embodiment discussed above, for the sake of simplicity, a case is supposed in which identical models and identical numbers of the electrical facilities 14 are installed in the base shop and the comparison shop, but the present disclosure is not limited thereto. For example, if at least one of the models and the numbers of the electrical facilities 14 installed in the base shop and the comparison shop is different, the influence on the equipment characteristics due to the difference in at least one of the models and the numbers may be measured in advance, and a correction for this influence may be computed to thereby apply the present disclosure.

In addition, in the embodiment discussed above, the shop parameter normalization unit 23 normalizes the power consumption of the comparison shop by using the base shop as a base of reference, but the shop parameter normalization unit 23 is not limited thereto. The shop parameter normalization unit 23 may also normalize both the power consumption of the base shop and the power consumption of the comparison shop according to a certain base of reference, and compare the normalized power consumption of the base shop to the normalized power consumption of the comparison shop. The certain base of reference may be based on factors such as the installed electrical facilities and environmental conditions of a standard shop, for example. The standard shop may be a real shop or a virtual shop.

In addition, in the embodiment discussed above, refrigeration facilities, freezer facilities, and air conditioning facilities are given as an example of the electrical facilities 14, but the present disclosure is not limited thereto. As above, the electrical facilities 14 may also include other facilities like lighting facilities such as fluorescent lights and LEDs, and electric heating facilities such as a fryer and a hot drink server, for example. To compare between the power consumption of electrical facilities 14 including the above between the base shop and the comparison shop, it is sufficient to store equipment characteristics for each type of electrical facilities in the equipment characteristics storage unit 25 in advance, and have the shop parameter normalization unit 23 read out information related to the relevant equipment characteristics matching the configuration of the electrical facilities 14 for each shop. Also, although the refrigeration facilities and the freezer facilities have been described collectively, the refrigeration facilities and the freezer facilities may also be deployed separately. In other words, it is also possible to deploy only the refrigeration facilities or only the freezer facilities as the electrical facilities 14.

In addition, in the embodiment discussed above, the locations where the electrical facilities 14 are installed are taken to be shops such as the base shop and the comparison shop, but the present disclosure is not limited thereto. For example, even if the locations are not commercial establishments such as shops, it is sufficient for the locations to be establishments in which power-consuming facilities of similar scale are installed. In other words, the present disclosure is also applicable to locations such as multiple offices, or collective housing such as housing complexes and apartment buildings, for example.

Furthermore, the foregoing embodiment describes displaying comparison data comparing power consumption between the base shop and one or more comparison shops on the display unit 11 of the base shop, but the comparison data may also be displayed on a display device provided in another location. Similarly, the comparison is conducted in response to an operation performed on the operating unit 12 of the base shop, but the comparison may also be conducted in response to an operation performed on an operation-accepting device provided in a location other than the base shop. In other words, a comparison may also be conducted in response to an operation performed on an operating unit provided in a location such as the head office of the corporation in charge of all shops, and comparison data may be displayed on a display unit provided in the head office, for example. Alternatively, in response to an operation performed on an operating unit in the head office, for example, comparison data comparing each shop to other shops may be displayed on the display unit 11 of all shops.

As described above, the control method of the information system 200 according to an embodiment of the present disclosure includes (a) accepting an instruction requesting for displaying of comparison between the power consumption of the electrical facilities 14 provided in the base shop (corresponding to a first establishment) and the power consumption of the electrical facilities 14 provided in a comparison shop (corresponding to a second establishment), and (b) displaying a comparison result comparing between the power consumption of the electrical facilities 14 of the base shop and the power consumption of the electrical facilities 14 of the comparison shop, the comparison result being calculated with reduced influence of the difference between an environmental condition of the base shop that influences the efficiency of the electrical facilities 14 of the base shop and an environmental condition of the comparison shop that influences the efficiency of the electrical facilities 14 of the comparison shop.

Note that the environmental condition that influences the efficiency of the electrical facilities 14 of the base shop is the outside temperature of the base shop, and the environmental condition that influences the efficiency of the electrical facilities 14 of the comparison shop is the outside temperature of the comparison shop.

In this way, according to the control method of the information system 200 according to an embodiment of the present disclosure, in order to compare the power consumption of the electrical facilities 14 of the base shop to the power consumption of the electrical facilities 14 of an other comparison shop, an environmental condition that influences the efficiency of the electrical facilities 14 installed in the base shop, namely the outside temperature of the base shop, and the outside temperature of the comparison shop are used to normalize the power consumption of the comparison shop by using the base shop as a base of reference, and the power consumption of the base shop is compared to the normalized power consumption of the comparison shop, thereby enabling a comparison between the power consumption of the base shop and the power consumption of the comparison shop with the influence of environmental conditions removed. In other words, it is possible to compare between the power consumption between the base shop and the comparison shop under similar conditions except for the method of operating the electrical facilities 14, and thereby objectively evaluate how much energy conservation is being achieved by the method of operating the electrical facilities 14 in the base shop. Consequently, when the power consumption of the base shop is high, the base shop may be instructed to improve the method of operating the electrical facilities 14. Furthermore, by applying to other shops the operating method of a shop with low power consumption from among multiple shops equipped with electrical facilities 14 under the same conditions, overall energy conservation across multiple shops may be promoted.

Note that the environmental condition that influences the efficiency of the electrical facilities 14 in the base shop and the comparison shop may be a factor other than the outside temperature of the base shop and the comparison shop described above, such as the outside humidity or the amount of sunshine. Also, the electrical facilities 14 may be at least one of air conditioning facilities, refrigeration facilities, and freezer facilities.

Furthermore, in the control method of the information system 200 according to an embodiment of the present disclosure, in step (b), a screen presenting comparison data calculated with reduced influence due to differences between the models of the electrical facilities of the base shop and the second electrical facilities is displayed. In other words, even if the electrical facilities 14 of the base shop and the electrical facilities 14 of the comparison shop are different models of electrical facilities, by acquiring differences in power consumption due to the models in advance, it is possible to make a correction to cancel out the differences due to the models when comparing the base shop to the comparison shop. Consequently, even if the electrical facilities 14 of the base shop and the electrical facilities 14 of the comparison shop are different models, it is still possible to compare power consumption under similar conditions except for the operating method.

An information terminal control method of the present disclosure includes (a) accepting an instruction requesting comparison and display of a power consumption of first electrical facilities provided in a first establishment and a power consumption of second electrical facilities provided in a second establishment, and (b) displaying, on a display, comparison data comparing between the power consumption of the first electrical facilities and the power consumption of the second electrical facilities, the comparison data being calculated with reduced influence of a difference between an environmental condition of the first electrical facilities that influences an efficiency of the first electrical facilities and an environmental condition of the second electrical facilities that influences an efficiency of the second electrical facilities.

Also, the environmental condition of the first electrical facilities that influences the efficiency of the first electrical facilities may be an outside temperature of the first establishment, and the environmental condition of the second electrical facilities that influences the efficiency of the second electrical facilities may be an outside temperature of the second establishment.

Also, the environmental condition of the first electrical facilities that influences the efficiency of the first electrical facilities may be an outside humidity of the first establishment, and the environmental condition of the second electrical facilities that influences the efficiency of the second electrical facilities may be an outside humidity of the second establishment.

Also, the environmental condition of the first electrical facilities that influences the efficiency of the first electrical facilities may be an amount of sunshine on the first establishment, and the environmental condition of the second electrical facilities that influences the efficiency of the second electrical facilities may be an amount of sunshine on the second establishment.

Also, the electrical facilities may be at least one of air conditioning facilities, refrigeration facilities, and freezer facilities.

Also, in the (b) displaying, a screen presenting the comparison data calculated with reduced influence of a difference in models between the first electrical facilities and the second electrical facilities may be displayed on the display.

An information system of the present disclosure includes an accepter that accepts an instruction requesting for displaying of comparison between a power consumption of first electrical facilities provided in a first establishment and a power consumption of second electrical facilities provided in a second establishment, a calculator that reduces influence of a difference between an environmental condition of the first electrical facilities that influences an efficiency of the first electrical facilities and an environmental condition of the second electrical facilities that influences an efficiency of the second electrical facilities, and calculates the power consumption of the first electrical facilities and the power consumption of the second electrical facilities, a display, and a controller that displays, on the display, comparison data comparing between the power consumption of the first electrical facilities and the power consumption of the second electrical facilities.

The foregoing thus discusses in detail an embodiment according to the present disclosure with reference to the drawings, but the functions of respective devices such as the shop device 1 and the server device 2 discussed above may also be realized by a computer program.

Figure 10:
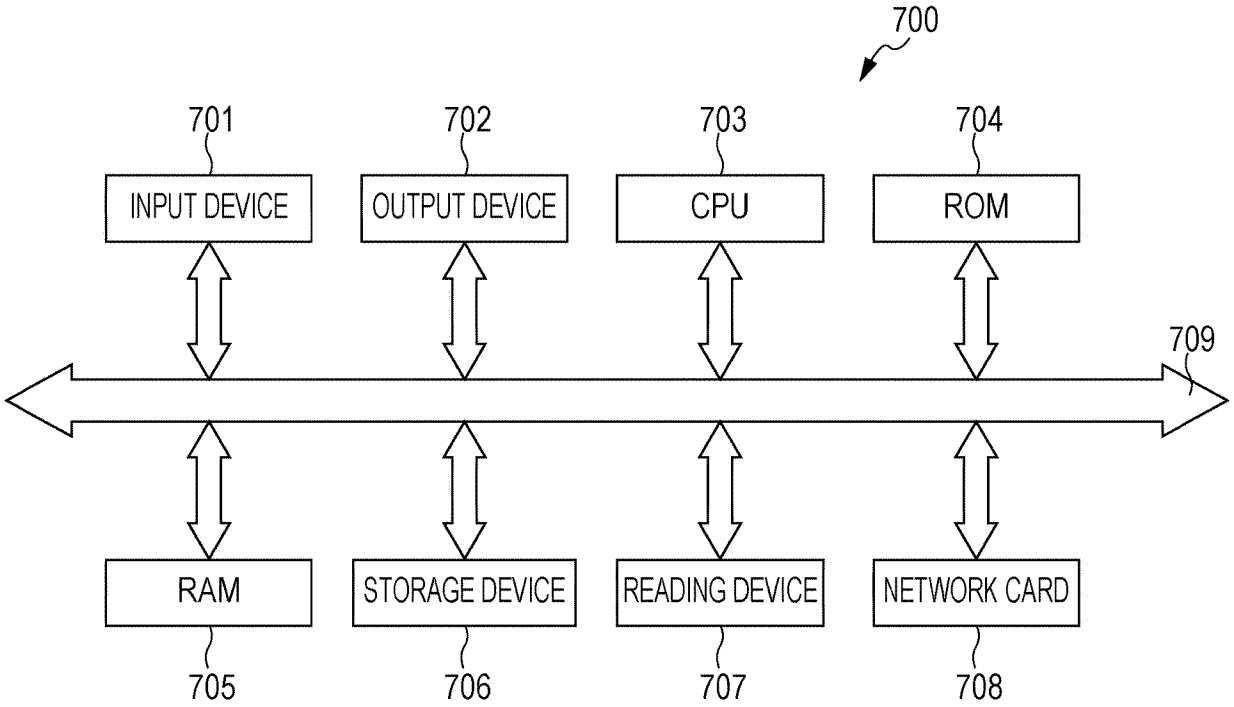
FIG. 10 is a diagram illustrating a hardware configuration of a computer that realizes the functions of respective devices according to a program.

FIG. 10 is a diagram illustrating a hardware configuration of a computer 700 that realizes the functions of the respective devices according to a program.

For example, the computer 700 is equipped with components like an input device 701 such as a keyboard, a mouse, and a touchpad, an output device 702 such as a display and a speaker, a CPU 703, read-only memory (ROM) 704, random access memory (RAM) 705, a storage device 706 such as a hard disk drive or a solid-state drive (SSD), a reading device 707 that reads information from a recording medium such as a Digital Versatile Disc-Read-Only Memory (DVD-ROM) or Universal Serial Bus (USB) memory, and a network card 708 that communicates over a network. The respective components are connected by a bus 709.

Additionally, the reading device 707 reads a program for realizing the functions of the above respective devices from a recording medium storing that program, and stores the read-out program in the storage device 706. Alternatively, the network card 708 communicates with a server device connected to a network, and stores, in the storage device 706, a program for realizing the functions of the above respective devices downloaded from the server device.

Subsequently, the functions of the above respective devices are realized as a result of the CPU 703 copying the program stored in the storage device 706 to the RAM 705, and sequentially reading out and executing instructions included in the program from the RAM 705.

In addition, the technology described in the foregoing embodiment may be realized in the following cloud service categories, for example. However, the categories for realizing the technology described in the foregoing embodiment are not limited to the following.

(Service Category 1: Self-Managed Data Center)

Figure 11:
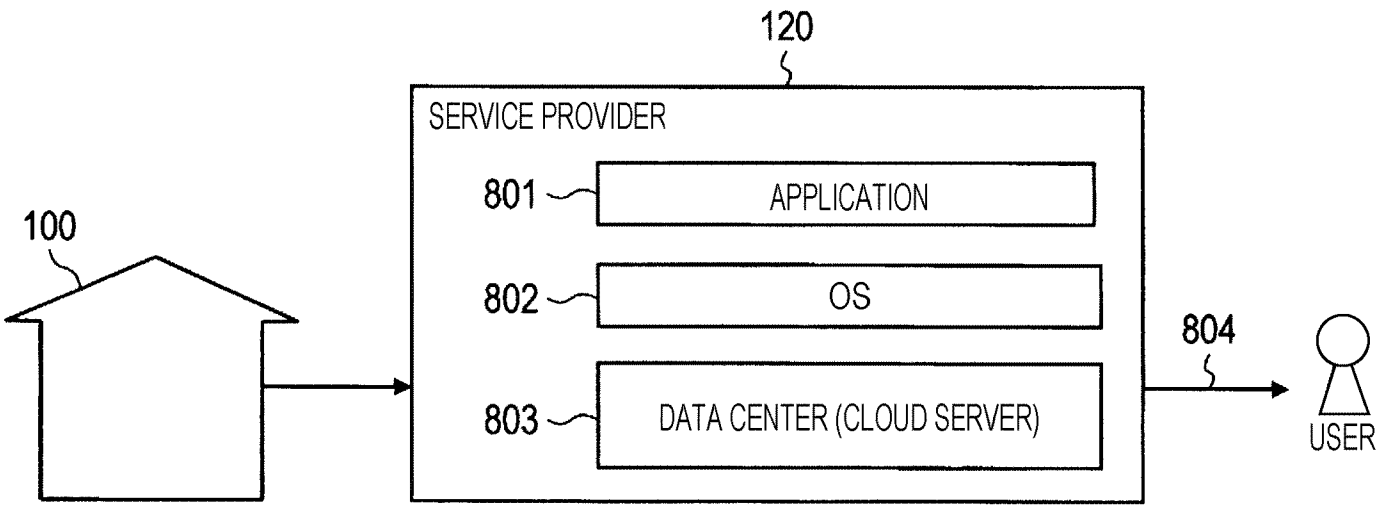
FIG. 11 is a diagram illustrating a service category 1 (self-managed data center)

FIG. 11 is a diagram illustrating a service category 1 (self-managed data center). In this category, a service provider 120 acquires information from a group 100, and provides a service to a user. In this category, the service provider 120 includes the functionality of a data center operating company. In other words, the service provider maintains a cloud server 111 that provides big data management. Consequently, a data center operating company does not exist.

In this category, the service provider 120 operates and manages a data center 803 (cloud server 111). The service provider 120 also manages an OS 802 and an application 801. The service provider 120 uses the OS 802 and the application 801 managed by the service provider 120 to provide a service 804.

(Service Category 2: Utilizing IaaS)

Figure 12:
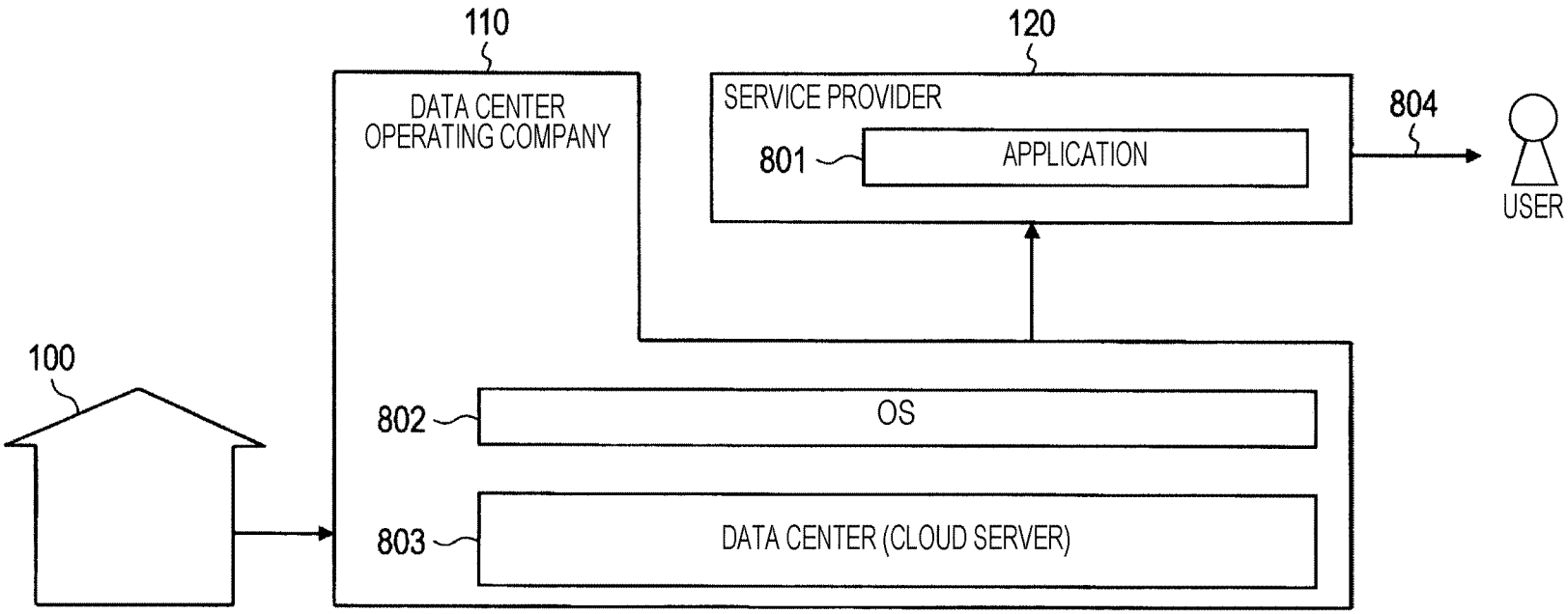
FIG. 12 is a diagram illustrating a service category 2 (utilizing IaaS)

FIG. 12 is a diagram illustrating a service category 2 (utilizing IaaS). Herein, IaaS is an acronym for Infrastructure as a Service, and refers to a cloud service model in which the infrastructure itself for building and running a computer system is provided as a service via the Internet.

In this category, the data center operating company operates and manages the data center 803 (cloud server 111). The service provider 120 also manages the OS 802 and the application 801. The service provider 120 uses the OS 802 and the application 801 managed by the service provider 120 to provide a service 804.

(Service Category 3: Utilizing PaaS)

Figure 13:
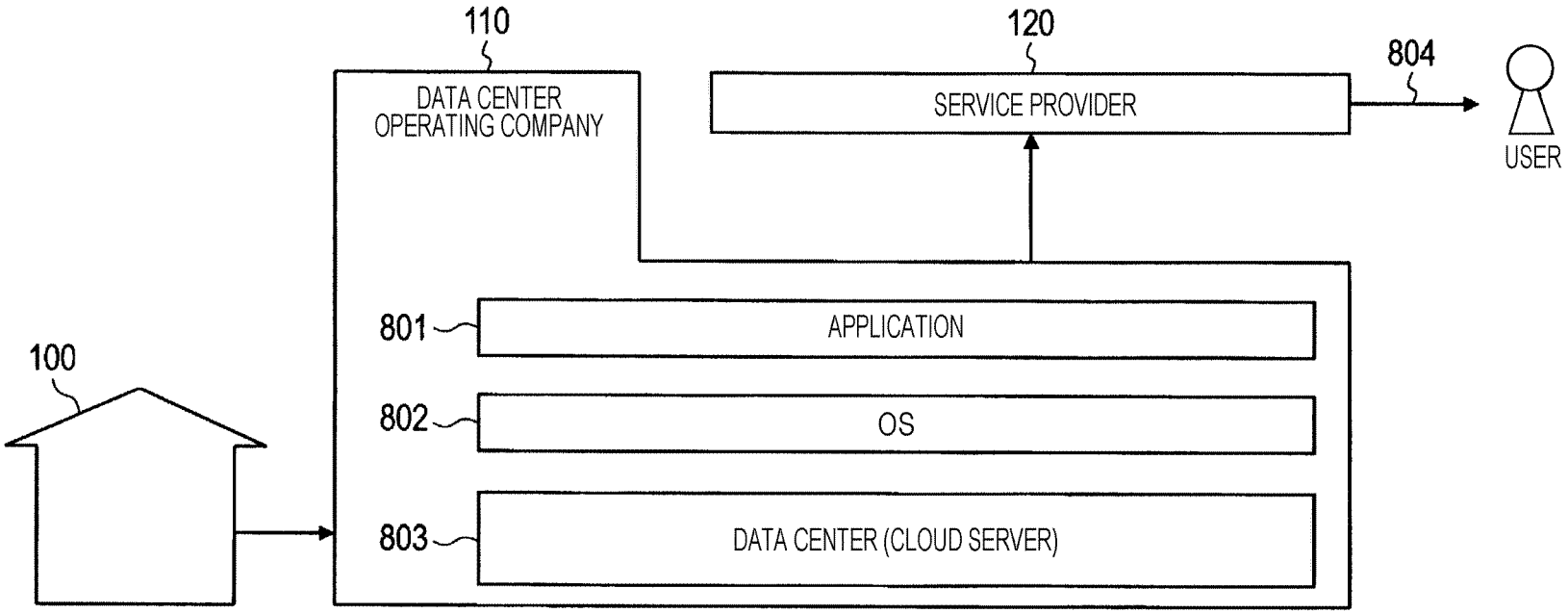
FIG. 13 is a diagram illustrating a service category 3 (utilizing PaaS)

FIG. 13 is a diagram illustrating a service category 3 (utilizing PaaS). Herein, PaaS is an acronym for platform as a service, and refers to a cloud service model in which the underlying platform for building and running software is provided as a service via the Internet.

In this category, the data center operating company 110 manages the OS 802, and also operates and manages the data center 803 (cloud server 111). Meanwhile, the service provider 120 manages the application 801. The service provider 120 uses the OS 802 managed by the data center operating company and the application 801 managed by the service provider 120 to provide a service 804.

(Service Category 4: Utilizing SaaS)

Figure 14:
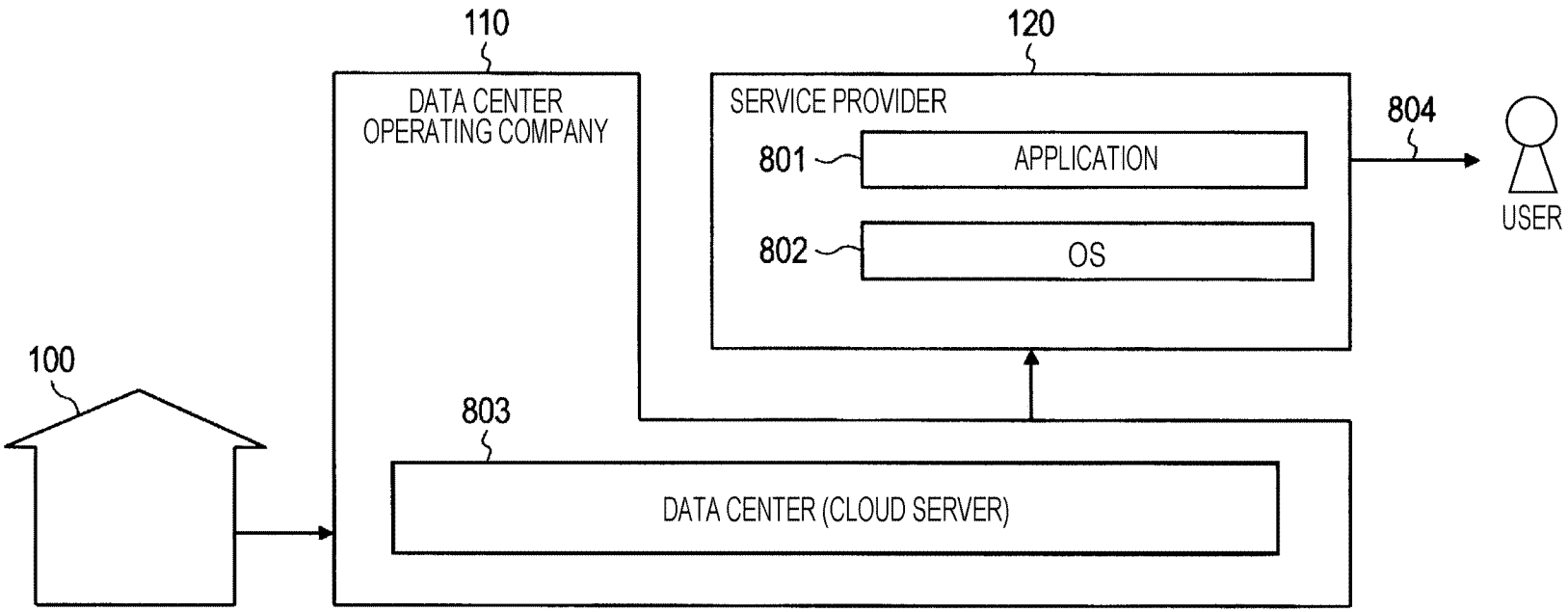
FIG. 14 is a diagram illustrating a service category 4 (utilizing SaaS).

FIG. 14 is a diagram illustrating a service category 4 (utilizing SaaS). Herein, SaaS is an acronym for software as a service. SaaS is a cloud service model provided with functions enabling a company or individual (user) who does not maintain a data center (cloud server) to use an application provided by a platform provider maintaining a data center (cloud server), for example.

In this category, the data center operating company 110 manages the application 801, manages the OS 802, and also operates and manages the data center 803 (cloud server 111). Meanwhile, the service provider 120 uses the OS 802 and the application 801 managed by the data center operating company 110 to provide a service 804.

All of the above categories suppose that the service provider 120 carries out the service-providing action. In addition, the service provider 120 or the data center operating company 110 may independently develop software such as the OS, application, or database for big data, or outsource such software to a third party, for example.

The present disclosure is suited to an information terminal control method enabling energy consumption amounts to be compared to other shops clearly.

What is claimed is:

1. A power consumption control method performed by an information terminal, the method comprising:

receiving, by a processor of an information terminal, an instruction requesting for displaying of comparison between a first power consumption of first electrical facilities provided in a first establishment and a second power consumption of second electrical facilities provided in a second establishment;

receiving, by the processor, the first power consumption of the first electrical facilities provided in the first establishment and the second power consumption of the second electrical facilities provided in the second establishment;

receiving, by the processor, a first environmental condition of the first electrical facilities that influences an efficiency of the first electrical facilities and a second environmental condition of the second electrical facilities that influences an efficiency of the second electrical facilities;

calculating, by the processor, a first modified power consumption and a second modified power consumption, from the first power consumption and the second power consumption by reducing influence of a difference between the first environmental condition and the second environmental condition; and displaying, on a display of the information terminal, comparison data comparing between the first modified power consumption of the first electrical facilities and the second modified power consumption of the second electrical facilities, wherein, when the displayed comparison data indicates that the first modified power consumption is greater than the second modified power consumption, the first electrical facilities are instructed to operate based on an operating method of the second electrical facilities.

2. The power consumption control method according to claim 1, wherein the first environmental condition of the first electrical facilities that influences the efficiency of the first electrical facilities is an outside temperature of the first establishment, and the second environmental condition of the second electrical facilities that influences the efficiency of the second electrical facilities is an outside temperature of the second establishment.

3. The power consumption control method according to claim 2, wherein the calculating comprising:

calculating a first standard power consumption for an average outside temperature of the first establishment from equipment characteristics of the first electrical facilities;

calculating a second standard power consumption for an average outside temperature of the second establishment from equipment characteristics of the second electrical facilities;

calculating a difference between the first standard power consumption and the second standard power consumption;

the second modified power consumption is calculated by adding the second power consumption and the difference between the first standard power consumption and the second standard power consumption.

4. The power consumption control method according to claim 1, wherein the first environmental condition of the first electrical facilities that influences the efficiency of the first electrical facilities is an outside humidity of the first establishment, and the second environmental condition of the second electrical facilities that influences the efficiency of the second electrical facilities is an outside humidity of the second establishment.

5. The power consumption control method according to claim 1, wherein the first environmental condition of the first electrical facilities that influences the efficiency of the first electrical facilities is an amount of sunshine on the first establishment, and the second environmental condition of the second electrical facilities that influences the efficiency of the second electrical facilities is an amount of sunshine on the second establishment.

6. The power consumption control method according to claim 1, wherein the electrical facilities comprise at least one of air conditioning facilities, refrigeration facilities, and freezer facilities.

7. The power consumption control method according to claim 1, wherein in the displaying, a screen presenting the comparison data calculated with reduced influence of a difference in models between the first electrical facilities and the second electrical facilities is displayed on the display.

8. A power consumption control system comprising:

a display;

a memory that stores instructions; and a processor that, when executing the instructions stored in the memory, performs operations comprising:

receiving an instruction requesting for displaying of comparison between a first power consumption of first electrical facilities provided in a first establishment and a second power consumption of second electrical facilities provided in a second establishment;

receiving the first power consumption of the first electrical facilities provided in the first establishment and the second power consumption of the second electrical facilities provided in the second establishment;

receiving a first environmental condition of the first electrical facilities that influences an efficiency of the first electrical facilities and a second environmental condition of the second electrical facilities that influences an efficiency of the second electrical facilities;

calculating a first modified power consumption and a second modified power consumption, from the first power consumption and the second power consumption by reducing influence of a difference between the first environmental condition and the second environmental condition; and displaying on the display, comparison data comparing between the first modified power consumption of the first electrical facilities and the second modified power consumption of the second electrical facilities, wherein, when the displayed comparison data indicates that the first modified power consumption is greater than the second modified power consumption, the first electrical facilities are instructed to operate based on an operating method of the second electrical facilities.

* * * * *